US007722743B2

(12) United States Patent
Best et al.

(10) Patent No.: US 7,722,743 B2
(45) Date of Patent: May 25, 2010

(54) METHOD FOR MANUFACTURING A FELT BELT, AND FELT BELT

(75) Inventors: Walter Best, Duren (DE); Christian Molls, Aachen (DE); Dieter Telgmann, Kreuzau (DE)

(73) Assignee: Heimbach GmbH & Co. KG, Duren (DE)

( * ) Notice: Subject to any disclaimer, the term of this patent is extended or adjusted under 35 U.S.C. 154(b) by 527 days.

(21) Appl. No.: 11/723,520

(22) Filed: Mar. 20, 2007

(65) Prior Publication Data

US 2007/0235155 A1 Oct. 11, 2007

(30) Foreign Application Priority Data

Mar. 21, 2006 (DE) ..... 20 2006 004 524 U
Mar. 21, 2006 (EP) ..... 06005717

(51) Int. Cl.
*D21F 7/08* (2006.01)
*D21F 7/12* (2006.01)
*B32B 5/00* (2006.01)

(52) U.S. Cl. ..... 162/358.2; 162/900; 162/904; 28/110; 428/58; 428/193; 428/194; 442/270; 156/304.6; 156/272.8; 156/179

(58) Field of Classification Search ..... 162/116, 162/348, 358.1, 358.2, 361, 900–904; 28/110, 28/141, 142; 139/383 AA; 428/57, 58, 192, 428/193, 194; 442/270–272; 156/304.1, 156/304.6, 272.2, 272.8, 179
See application file for complete search history.

(56) References Cited

U.S. PATENT DOCUMENTS 4,781,967 A 11/1988 Legge et al.
5,268,076 A 12/1993 Best et al.
5,360,656 A 11/1994 Rexfelt et al.
5,713,399 A * 2/1998 Collette et al. ..... 139/383 AA
6,162,518 A 12/2000 Korfer
6,425,985 B1 7/2002 Hagfors et al.
6,811,849 B2 11/2004 Best
6,896,771 B2 * 5/2005 Best et al. ..... 162/358.2
7,381,307 B2 * 6/2008 Silakoski ..... 162/358.2
2003/0183296 A1 * 10/2003 Moriarty et al. ..... 139/383 B (Continued)

FOREIGN PATENT DOCUMENTS

EP 0 464 258 1/1992

(Continued)

*Primary Examiner*—Eric Hug
(74) *Attorney, Agent, or Firm*—Berenato & White, LLC

(57) ABSTRACT

The invention is a method for manufacturing a felt belt having a support which is embedded in a fiber matrix and is made up of at least two yarn layers arranged one above another, at least one is a longitudinal yarn layer made up of longitudinal yarns extending in parallel fashion, and at least one is a transverse yarn layer made up of transverse yarns extending in parallel fashion, transverse yarns being present that are continuous over the width of the felt belt. For each longitudinal yarn layer, a first support module is manufactured, by means of a first auxiliary support web, at a width that is less than the width of the completed felt belt, the first auxiliary support web being wound in helical fashion, before, during, or after the application of yarns, to a width that corresponds to the width necessary for manufacture of the completed felt belt.

37 Claims, 4 Drawing Sheets

U.S. PATENT DOCUMENTS

2003/0207069 A1* 11/2003 Moriarty ..... 428/60
2005/0130531 A1* 6/2005 O'Connor et al. ..... 442/189

FOREIGN PATENT DOCUMENTS

EP 0 947 623 10/1999
EP 1 209 283 5/2002
EP 1 359 251 11/2003

* cited by examiner

METHOD FOR MANUFACTURING A FELT BELT, AND FELT BELT

CROSS-REFERENCE TO RELATED APPLICATIONS AND CLAIM TO PRIORITY

This application is related to application number 06 005 717.1 filed Mar. 21, 2006 in the European Patent Office the disclosure of which is incorporated by reference and to which priority is claimed.

FIELD OF THE INVENTION

The invention relates to a method for manufacturing a felt belt having a support, which latter is embedded in a fiber matrix and is made up of at least two yarn layers arranged one above another, of which at least one is embodied as a longitudinal yarn layer made up of longitudinal yarns extending in parallel fashion, and at least one as a transverse yarn layer made up of transverse yarns extending in parallel fashion, transverse yarns being present that are continuous over the width of the felt belt. The invention further relates to a felt belt of this kind, in particular as a paper machine felt.

BACKGROUND OF THE INVENTION

In the field of paper machine belts in particular, felt belts are known in which a support made up of textile plastic yarns is embedded in a fiber matrix of plastic fibers. Paper machine belts of this kind are used chiefly as press felts in the press section of a paper machine. The fiber matrix is manufactured in such a way that one or more nonwoven fabric layers are needle-felted onto the support on one or both sides.

In the felt belt of the species, the support is made up not of a woven fabric but of at least two yarn layers arranged one above another. A yarn layer has yarns that are arranged in parallel fashion at a distance from one another and that, unlike in woven and knitted fabrics, are not engaged into one another. The yarn layers are arranged so that the yarns of adjacent yarn layers intersect, generally in such a way that one yarn layer is embodied as a longitudinal yarn layer having longitudinal yarns extending in the longitudinal direction of the felt belt, and one yarn layer is embodied as a transverse yarn layer having transverse yarns proceeding in the transverse direction.

A felt belt of this kind in the form of an endless press felt is disclosed in U.S. Pat. No. 4,781,967. For manufacture of the felt belt, firstly modules are formed that are made up either entirely of a fiber layer or of a combination of fiber layer and yarn layer. Regarding the manufacture of these modules, the reader is referred to U.S. Pat. No. 3,613,258. The individual modules are then laid onto one another and joined to one another without the use of binding yarns, in part using extruded polymer material. The manner in which an endless felt belt results from the joining of the individual modules is not evident from U.S. Pat. No. 4,781,967.

Because hot-melt adhesive fibers or adhesive is used, the press felts according to U.S. Pat. No. 4,781,967 are relatively dense (cf. U.S. Pat. No. 6,425,985 B1, col. 1, lines 38 to 47) and stiff. This limits the usability of such felt belts in paper machines.

EP 1 359 251 A1 likewise discloses a support made up of at least two yarn layers arranged one above another, in which context the support can also be covered with a fiber layer. Manufacture of the support proceeds in such a way that the longitudinal yarns are stretched parallel to one another between two yarn beams, and the transverse yarns are then laid over the longitudinal yarns. The transverse yarns are then fused to the longitudinal yarns by being heated (in a manner confined to their intersection points) to melting temperature. Heating of the yarns can be accomplished by means of a laser beam when the yarns are equipped with an additive that promotes absorption of the laser beam.

Although a highly dimensionally stable support is obtained with this method, a prerequisite therefore is that the longitudinal and transverse yarns abut one another in planar fashion, which requires a specific yarn shape. This yarn shape in turn conflicts with embedding of the support into a fiber matrix by means of needle-felting of nonwoven fabric layers. Such supports are therefore of only limited suitability for the manufacture of press felts, and are intended chiefly for use in the dryer section of a paper machine, and in that case without a fiber layer or fiber matrix.

EP 0 464 258 A1 describes a method for manufacturing a felt belt, in particular as a press felt, in which the support is built up by the fact that a support web strip whose width is substantially less than the intended width of the support is wound in helical or screw-shaped fashion onto two spaced-apart rollers until the intended width of the support is reached. Simultaneously or subsequently, the support is covered in the same way with nonwoven fabric strips, and the nonwoven fabric web thus formed is needle-felted to the support. The oblique side edges of a felt belt constructed in this fashion are then trimmed so as to yield straight side edges that extend in the machine direction.

With this manner of manufacturing the support, the longitudinal yarns extend, because of the winding process, at an angle to the longitudinal direction of the felt belt, and continuous transverse yarns are not obtained, so that the transverse strength of the felt belt is not very high. In order to obtain better transverse strength, it has been proposed to join the edges of the support web strips to one another, for example by stitching (U.S. Pat. No. 5,360,656). In the context of supports manufactured from yarn layers, the edges of the support web strips are, according to EP 0 947 623 A1, joined to one another by the fact that the transverse yarns of the transverse yarn layer engage into one another at the edges, and a joining yarn is laid on there and is welded to the portions of the transverse yarns that interengage. This has the disadvantage, however, that in the region of the edges a strip is created that, because of the differing arrangement and density of the yarns, has properties that are different from those of the other surfaces of the felt belt, in particular lower permeability. This can result in marks on the paper.

To remedy this, it is proposed in EP 1 209 283 A1 to embody the edges of the support web strips in meander fashion with successive projections and indentations, and to abut the support web strips against one another in such a way that the projections and indentations interengage, such that the projections completely fill the indentations. The edges are then joined via joining means, for example stitched seams or adhesive strips. This too, however, results in changes in the properties of the completed felt belt in the region of the interengaging edges.

SUMMARY OF THE INVENTION

It is the object of the invention to make available a method for manufacturing a felt belt having a support, which latter is constructed from longitudinal and transverse yarn layers and embedded into a fiber matrix, with which a felt belt can be manufactured in simple and therefore economical fashion and with high transverse strength and properties that are consistent over its width.

This object is achieved, according to the present invention, by a method having at least the following method steps:

a) for each longitudinal yarn layer, a first support module is manufactured as follows:
   aa) a first auxiliary support web is manufactured, at a width that is less than the width of the completed felt belt;
   ab) the first auxiliary support web is brought together with yarns which have the property of absorbing laser energy and of being able to be brought by means of laser energy at least superficially and at least partially to melting temperature;
   ac) the yarns are joined to the first auxiliary support web by the action of a laser beam;
   ad) before, during, or after application of the yarns, the first auxiliary support web is wound in helical fashion to a width that, if applicable after trimming of the side edges, corresponds to the width necessary for manufacture of the completed felt belt;
b) for each transverse yarn layer, a second support module that completely covers the first one is manufactured as follows:
   ba) firstly, individual support module segments are manufactured, having an extension in one direction that corresponds to the width necessary for manufacture of the completed felt belt;
   bb) the support module segments are each made up of a combination of a second auxiliary support web and yarns, attached thereon, that have the property of absorbing laser energy and of being able to be brought by means of laser energy at least superficially and at least partially to melting temperature;
   bc) the join between the auxiliary support web and yarn layer has been produced by the action of a laser beam on the yarns;
   bd) for manufacture of a support belt, the support module segments are placed onto and against one another onto the first support module, one behind another in the latter's longitudinal direction, so that a second support module is created having yarns that extend transversely to the yarns of the first support module;
c) for manufacture of the felt belt, at least one nonwoven fabric layer is needle-felted onto at least one side of the support modules, forming the fiber matrix.

The fundamental idea of the invention is thus to manufacture the support by the fact that for each longitudinal yarn layer, an endless support module is produced, in one or more plies, by helical winding of at least one auxiliary support web having longitudinal yarns lasered on previously, concurrently, or subsequently; and that onto this support module, support module segments likewise made up of an auxiliary support web and yarn layers lasered thereonto are laid on, in single- or multiple-ply fashion, in such a way that the yarns extend in the transverse direction; and that finally, a nonwoven fabric layer is needle-felted on in order to join the support modules and form the fiber matrix. It is not detrimental if the auxiliary support webs are thereby largely destroyed, since they serve merely to hold the yarns in the intended positions during the manufacturing operation. This is handled, after the nonwoven fabric layer(s) is/are needle-felted on, by the fiber matrix.

With the aid of this method, felt belts can be manufactured in simple and economical fashion utilizing the advantages of a winding process. Because they comprise continuous transverse yarns, their transverse strength is high. The felt belts are furthermore notable for the fact that their properties, in particular their permeability to water, which is important for use in a paper machine, are uniform over their surface.

In an embodiment of the invention, provision is made that yarns are used which contain an additive that makes the yarns absorptive for the laser beam. Examples of such additives are NIR-active substances (i.e. substances active in the near infrared) that absorb, for example, in the region of the wavelengths 808 nm, 940 nm, 980 nm, or 1064 nm. Suitable for this are, for example, carbons or colorless additives such as Clearweld® of Gentex or Lumogen® IR of BASF. The additive preferably extends over the entire length of the yarns. The additive can be incorporated into the yarns and/or applied onto the surface of the yarns. When the additive is incorporated, the weight proportions should be 0.10% to 2.5%.

The auxiliary support webs can be made of a nonwoven fabric and/or a plastic network such as the one known, for example, from EP 0 285 376 B, EP 0 307 182 A, WO 91/02642, or WO 92/17643, and/or a film made preferably of plastic. When a nonwoven fabric is used, it should have a weight per unit area from 20 to 150 g/m$^2$, a weight per unit area from 30 to 60 g/m$^2$ being sufficient for application of the method according to the present invention. The nonwoven fabric can also contain hot-melt adhesive fibers.

The auxiliary support web should in principle be made of a material that absorbs laser energy substantially less than the yarns, or that absorbs no laser energy. These are, as a general rule, the usual thermoplastic materials such as polyamide 4.6, 6, 6.6, 6.10, 6.12, 11, 12, as well as polyester, polypropylene, etc. The yarns themselves can also, except for the additive, be manufactured from the aforesaid materials, usefully from the same ones as used for the auxiliary support webs. The same is analogously true for the nonwoven fabric layer(s) to be needle-felted on in conclusion; in the case of multiple layers, different fiber deniers can be provided, preferably in such a way that the finest fiber deniers end up on the paper-side surface of the felt belt.

Provision is furthermore made according to the invention that the yarns are arranged parallel to the side edges of the auxiliary support webs, preferably at equal distances. As a result of the helical winding process of the first auxiliary support web, once the felt belt has been completed, the longitudinal yarns extend not exactly its longitudinal direction but slightly obliquely with respect thereto.

Because the first support module is manufactured by means of a helical winding process, it is sufficient if the auxiliary support web used for winding is manufactured at a width from 0.2 to 1.5 m. The second auxiliary support web usefully has an extension, transversely to the yarns that have been or are to be applied, from 0.5 to 6 m, preferably 3 to 6 m. The support module segments can be manufactured in such a way that firstly an auxiliary support web of a greater length is manufactured and the yarns are lasered on, and the belt thus constituted is then divided at intervals that correspond to the felt belt width necessary for manufacture of the completed felt belt. Manufacture of the second support web can be carried out by means of methods known in the existing art.

The felt belt is manufactured in endless fashion, since the first support module is also already endless, and the respective second support module is assembled from the support module segments to yield a module that is likewise endless.

To ensure that a dislocation of yarns does not occur during the manufacturing process, the first auxiliary support web or the support module segments, preferably both, should be joined to one another at their mutually abutting edges. This can be done in various ways.

On the one hand, the edges can be caused to overlap and then joined to one another in the overlap region. In practice, this is done in such a way that one of the two edges is not covered with yarns over a width from 10 to 50 mm, and this edge is then caused to overlap with the edge located next to it, which is equipped with yarns. The two edges can then be joined by welding via ultrasound, or by adhesive bonding. It is also possible to employ the yarns themselves for this, by once again impinging upon them in the edge region with a laser beam. The edges can, however, also be stitched to one another. The thickening in the overlap region is insignificant because the auxiliary support web is not very thick, especially since the thickening is largely destroyed upon later needle-felting of the nonwoven fabric layer.

A thickening does not occur when the edges are butted against one another. In this case, the edges can be joined by the fact that the edges are equipped with successive, complementary projections and indentations; and the edges can then be placed against one another so that they interengage with their projections and indentations; and lastly, projections of the abutting edges are joined to one another. Joining of the projections can be accomplished by the fact that at least one yarn extends over the projections, preferably parallel to the other yarns, and this at least one yarn (which can also be multiple yarns extending in parallel fashion) is joined to some or all of the projections.

In terms of method, two alternatives are available for this. In the first alternative, at least one yarn is laid over the projections after interengagement of the projections and indentations, and then attached to them. As an alternative thereto, however, provision can also be made that even before interengagement of the projections and indentations (preferably concurrently with the placement and attachment of the other yarns), at least one yarn is laid over the projections and indentations of at least one edge of the first auxiliary support web and/or second auxiliary support web, and attached to the projections; and after interengagement of the projections and indentations, the at least one yarn is also attached to projections of the butt-adjoining edge. The attachment of the at least one yarn prior to interengagement can be confined to one of the two edges of the first and/or second auxiliary support web, but can also be accomplished on both edges, preferably symmetrically in such a way that the yarn or yarns extend(s) at most to half the width (transversely to the longitudinal direction) of the projections.

The conformation of the projections and indentations is relatively unrestricted. Examples thereof are evident from EP 1 209 283 A1. The projections should preferably fill up the entire area of the indentations. Attachment of the at least one yarn can be accomplished in a variety of ways, but preferably so that for this purpose as well, a yarn capable of absorbing laser energy is used, and it is then attached by means of a laser beam to, preferably, all the projections.

Usefully, the yarns extending over the edges should correspond to the other yarns, i.e. should be identical to them. The yarns should furthermore be applied onto the edges in a quantity and at a distance such that after interengagement of the projections and indentations, the yarn density in the region of the edges does not deviate from the yarn density elsewhere. Both actions serve to achieve uniform properties over the surface of the felt belt.

The subject matter of the invention is furthermore a felt belt that has been manufactured with the aid of the method according to the present invention and accordingly comprises a support that is embedded in a fiber matrix and is made up of at least two yarn layers arranged one above another, transverse yarns being present that are continuous over the width of the felt belt, and the yarns having the property of absorbing laser energy so that they can be brought by means of laser energy at least superficially and at least partially to melting temperature. According to the present invention, the longitudinal yarns extend at an angle to the longitudinal direction of the felt belt. This embodiment allows the felt belt to be manufactured with the aid of a winding process, and consequently in simple and economical fashion, without sacrificing the advantage of continuous transverse yarns and therefore high transverse strength. Because the support is embedded into a fiber matrix, it is not necessary to join the longitudinal and transverse yarns to one another. It is sufficient merely to lay them onto one another.

The oblique position of the longitudinal yarns is achieved by the helical winding process upon manufacture of the first longitudinal yarn module and, if applicable, further first longitudinal yarn modules. The possibility also exists, in this context, of winding on the first auxiliary support web in multiple plies, preferably in such a way that the longitudinal yarns intersect at a very acute angle, usefully so that the angles with respect to the longitudinal direction of the felt belt are of equal magnitude, i.e. the profile of the longitudinal yarns is reflected.

The property of being able to absorb laser energy can be obtained with the aid of the additives described above. The yarns can be embodied as monofilaments, bicomponent yarns in which only one of the two components contain the additive also being a possibility. The bicomponent yarns should preferably comprise a core and a sheath surrounding it, the additive then being contained only in the sheath.

As an alternative to or in combination with monofilaments, the yarns of at least one yarn layer can also be embodied as multifilaments made up of individual filaments. In this case only some of the individual filaments need to be equipped with the additive, a proportion of at most 50% being sufficient. Upon impingement with the laser beam, the multifilaments stiffen as a result of the welding of even some of the individual filaments to one another.

Monofilament twisted yarns made up of, for example, two to twelve monofilaments are, however, also a possibility; here again, not all the monofilaments need to be equipped with additives. It is sufficient if a maximum of 50% thereof have such additives. Here as well, the welding of the individual monofilaments to one another causes a stiffening of the twisted yarns.

Provision is further made, according to the invention, that different yarns are used alternately, for example alternately monofilaments and multifilaments, monofilaments and twisted yarns, or multifilaments and twisted yarns. The material, however, can also be used alternately, for example by using yarns made alternately of polyamide 6 and 6.10, or alternately of polyamide 6 and 6.12, or alternately of polyamide 6.6 and polyester.

A usable felt belt is produced even when only one longitudinal yarn layer and one transverse yarn layer are present. Higher strength is achieved when the support is made up of at least two longitudinal yarn layers and at least one transverse yarn layer. Also possible, however, is a converse structure made up of one longitudinal yarn layer and two transverse yarn layers. For stringent structural requirements, at least two longitudinal yarn layers and at least two transverse yarn layers can be combined with one another. In all cases, it is useful if a longitudinal yarn layer and a transverse yarn layer respectively alternate.

The transverse yarns need not extend at exactly a right angle to the longitudinal direction of the felt belt. The possibility also exists for the transverse yarns to extend at an angle from 75° to 125°, preferably 80 to 100°, to the longitudinal direction of the felt belt. If the support comprises at least two transverse yarn layers, the possibility exists of arranging the transverse yarns in such a way that the transverse yarns of the one transverse yarn layer and the transverse yarns of the other transverse yarn layer intersect, preferably symmetrically, so that the transverse yarns of the one transverse yarn layer deviate from the perpendicular to the longitudinal direction of the felt belt by the same angle as the transverse yarns of the other transverse yarn layer, but with the opposite sign.

In order to achieve uniform properties over the surface, the longitudinal yarns and/or the transverse yarns should be at equal distances from one another. It is useful in this context if the distance of the longitudinal yarns and the distance of the transverse yarns is the same. It can, however, also be different. It is likewise possible to use different yarns for the longitudinal yarns than for the transverse yarns, but also identical yarns.

BRIEF DESCRIPTION OF THE DRAWINGS

The invention is illustrated in further detail, with reference to exemplifying embodiments, in the drawings, in which.

DETAILED DESCRIPTION OF THE PREFERRED EMBODIMENT(S)

Figure 1:
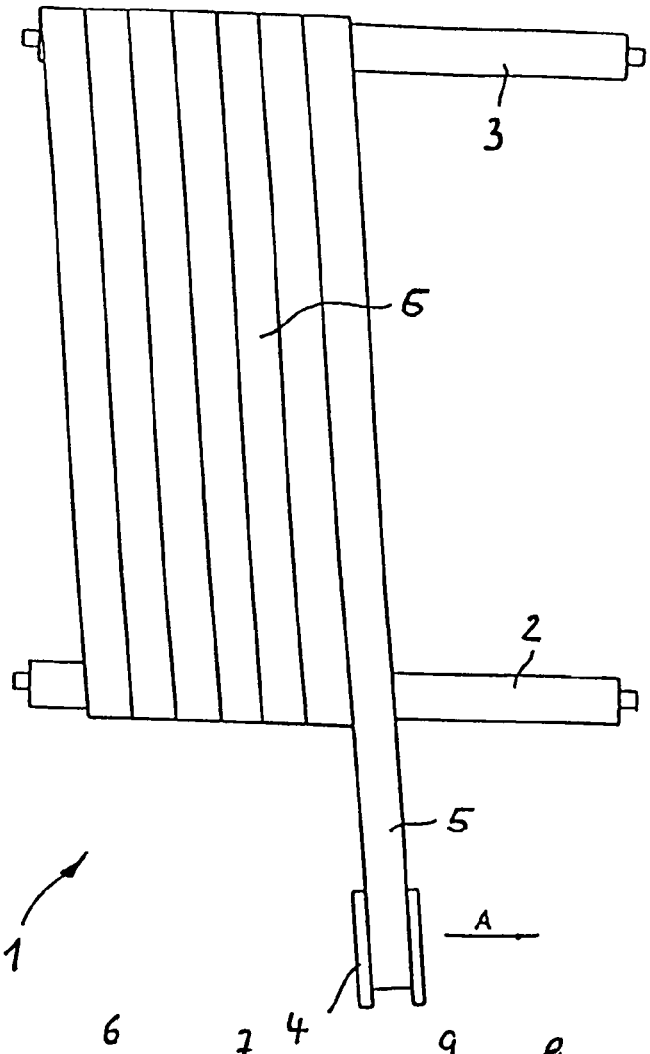
FIG. 1 is a top view of an apparatus for manufacturing a first support module for the felt belt according to the present invention.

Apparatus 1 depicted in FIG. 1 comprises two spaced-apart rollers 2, 3 that have parallel rotation axes and are driven in the same direction. Located at a distance from lower roller 2 is a supply spool 4 on which a nonwoven fabric strip 5 having a low weight per unit area is wound. Nonwoven fabric strip 5 is pulled off from supply spool 4 when rollers 2, 3 are driven, and becomes wound onto the two rollers 2, 3. In this context, supply spool 4 is moved in the direction of arrow A, i.e. parallel to the rotation axes of rollers 2, 3. As a result, nonwoven fabric strip 5 is progressively wound helically to the right onto rollers 2, 3. The advance of supply spool 4 in the direction of arrow A is dimensioned so that nonwoven fabric strips 5 end up butted against one another. To ensure that jamming does not occur, supply spool 4 is set correspondingly obliquely. The winding process is continued until by means of nonwoven fabric strip 5, a nonwoven fabric belt has been manufactured whose width corresponds approximately to the width of the felt belt (prior to heat-setting) that is to be manufactured by means of the nonwoven fabric belt.

Figure 2:
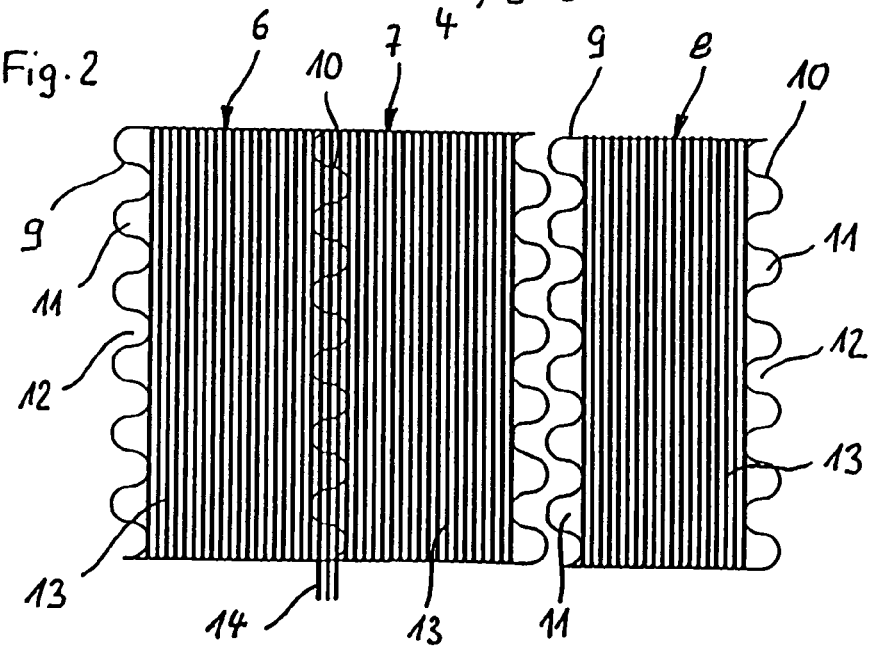
FIG. 2 is a top view, in an enlarged depiction, of a portion of the auxiliary support web for manufacturing the first support module.

In the enlargement shown in FIG. 2, three partial webs 6, 7, 8 of nonwoven fabric strip 5 are depicted. It is apparent that nonwoven fabric strip 5—and therefore partial webs 6, 7, 8—have complementary undulating profiles on both longitudinal edges 9, 10, thus creating alternately projections (labeled 11 by way of example) and complementary indentations (labeled 12 by way of example). In the case of partial webs 6, 7, projections 11 and indentations 12 interengage in the manner of a tooth set, with projections 11 filling up the entire area of indentations 12. Partial web 8 is depicted at a distance from partial web 7. In fact, it runs into apparatus 1 in such a way that projections 11 fit into indentations 12 in the same way as is the case for the adjacent edges 9, 10 of partial webs 6, 7. In addition, the partial web adjoining partial web 6 to the left is omitted.

As is also evident from FIG. 2 (and not depicted in FIG. 1), longitudinal yarns (labeled 13 by way of example) extending in the longitudinal direction of nonwoven fabric strip 5 are applied thereonto in parallel fashion and at equal distances from one another, although longitudinal edges 9, 10 are left yarn-free. Longitudinal yarns 13 are made of a thermoplastic and are equipped with an additive that makes them absorptive for laser energy. Longitudinal yarns 13 are welded in point fashion to nonwoven fabric strip 5 by the action of a laser beam moving transversely back and forth. The join can be created even before nonwoven fabric strip 5 is wound onto supply spool 4, in a corresponding apparatus. In this case what is present on supply spool 4 is not merely a nonwoven fabric strip 5, but a nonwoven fabric strip 5 equipped with longitudinal yarns 13.

As is evident from FIG. 2, three further longitudinal yarns (labeled 14 by way of example) are applied onto longitudinal edges 9, 10 and onto projections 11. They are identical to longitudinal yarns 13, and therefore also capable of absorbing laser energy. Like longitudinal yarns 13, they are heated in point fashion to melting temperature with a laser beam, and thereby become joined to projections 11. Edges 9, 10, and thus partial webs 6, 7, 8, are thereby joined to one another. Longitudinal yarns 14 on longitudinal edges 9, 10 are at equal distances from one another and from the adjacent longitudinal yarns 13, so that the yarn density in the region of longitudinal edges 9, 10 corresponds to that in the remaining area.

In the example according to FIG. 2, the application of longitudinal yarns 14 onto longitudinal edges 9, 10 takes place after the application of longitudinal yarns 13 between longitudinal edges 9, 10. It is not precluded, however, for a reverse sequence to be selected, i.e. firstly the joining of partial webs 6, 7, 8 is effected by means of longitudinal yarns 14, and then the remaining longitudinal yarns 13 are applied. This can take place respectively in separate apparatuses that bring about placement of longitudinal yarns 13, 14 on the one hand and attachment by means of a laser on the other hand. The possibility also exists, however, of carrying this out in one working step, if this apparatus is arranged between rollers 2, 3, and longitudinal yarns 13, 14 are simultaneously laid next to one another and set. In this case, however, it is necessary for the two rollers 2, 3 to be moved opposite to the direction of arrow A, and for supply spool 4 to be held in stationary fashion.

Figure 3:
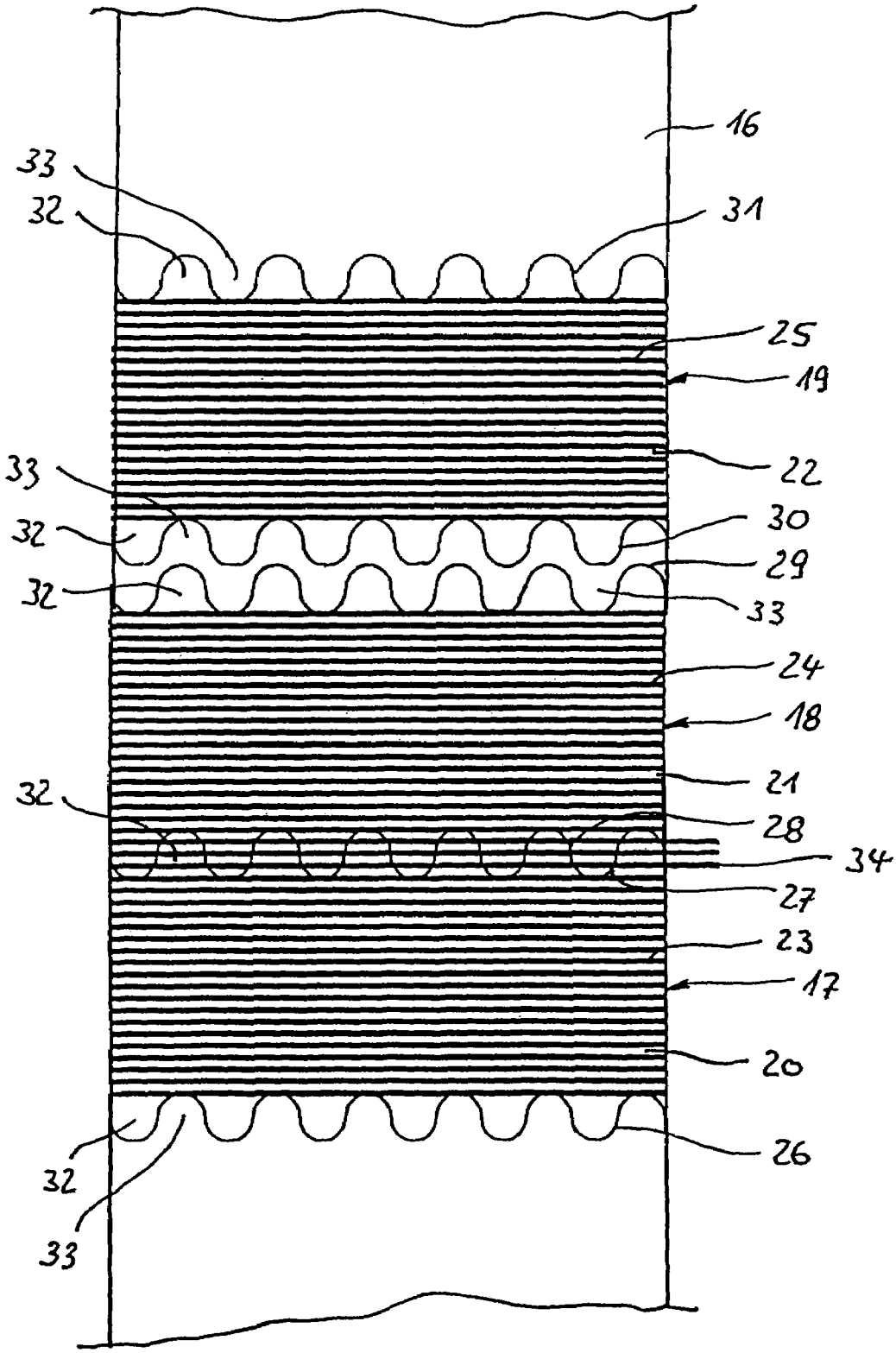
FIG. 3 is a top view of a portion of the first support module, with support module segments placed thereonto for manufacturing the second support module.

FIG. 3 shows, at approximately the scale of FIG. 1 but substantially smaller as compared with FIG. 2, a portion of a first support module 16 that was manufactured by continuing the helical winding process evident from FIG. 1 up to the intended width of the felt belt prior to heat-setting. Support module segments 17, 18, 19 are then placed onto support module 16 that is still on apparatus 1. These support module segments 17, 18, 19 are constructed in just the same fashion as nonwoven fabric strips 5 from which first support module 16 was manufactured. They are each made up of a nonwoven fabric web 20, 21, 22 onto which transverse yarns (labeled respectively 23, 24, 25 by way of example) are applied. Transverse yarns 23, 24, 25 are identical to longitudinal yarns 13, 14 of support module 16 (omitted in FIG. 3) and are therefore also attached to nonwoven fabric webs 20, 21, 22 in the same fashion by means of a laser beam. They are each at the same distance from one another. Support module segments 17, 18, 19 are laid onto first support module 16 with transverse yarns 23, 24, 25 bottommost, so that transverse yarns 23, 24, 25 are in contact with longitudinal yarns 13, 14.

Support module segments 17, 18, 19 comprise transverse edges 26 to 31 that are left unoccupied by transverse yarns 23, 24, 25. They are equipped, in the same fashion as longitudinal edges 9, 10 of nonwoven fabric strip 5, with successive projections (labeled 32 by way of example) and complementary indentations (labeled 33 by way of example). Lower transverse edge 28 of center support module segment 18 is placed against upper transverse edge 27 of lower support module segment 17 in such a way that its projections 32 and indentations 33 interengage in the manner of a tooth set. Three transverse yarns (labeled 34 by way of example) are laid over projections 32 and attached to them. The two support module segments 17, 18 are joined to one another via these transverse yarns 34. Here again, attachment can be accomplished by means of a laser beam.

Upper support module segment 19 is placed onto first support module 16. In order to be joined to center support module segment 18, upper support module segment 19 must still be displaced toward center support module segment 18 sufficiently far that projections 32 on lower transverse edge 30 fit into indentations 33 on upper transverse edge 29 of center support module segment 18 in the same way as between support module segments 17, 18. Here as well, a further three transverse yarns can be put in place and joined to projections 32. In this fashion, further support module segments are successively laid against the respective previous support module segment and respectively joined to it, until first support module 16 is completely covered with support module segments 17, 18, 19. Support module segments 17, 18, 19 then together form a second support module 35. In principle, any number of further first and second support modules can thereby be constructed.

Figure 4:
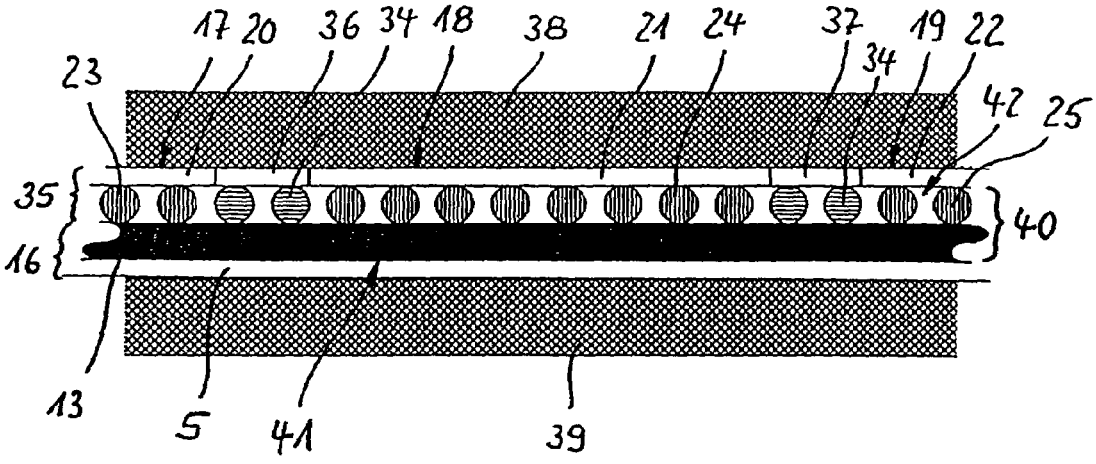
FIG. 4 is a longitudinal section through the felt belt according to the present invention having the first and second support modules according to FIGS. 1 to 3.

FIG. 4 shows the combination of first support module 16 having longitudinal yarns 13 and nonwoven fabric strip 5, and second support module 35 made up of support module segments 17, 18, 19 that are joined to one another at edge regions 36, 37 (here, unlike in FIG. 3, only two transverse yarns 34 extend over edge regions 36, 37). Located on the upper side of second support module 35 and the lower side of first support module 16 are nonwoven fabric layers 38, 39. They are joined to the two support modules 16, 35 by the fact that the unit shown in FIG. 4 is conveyed to a needling machine. There nonwoven fabric layers 38, 39 are compressed to form a fiber matrix, and are in part introduced into the interstices between longitudinal and transverse yarns 13, 14, 23, 24, 25, 34. In this context, nonwoven fabric strip 5 and nonwoven fabric webs 20, 21, 22 are largely destroyed. After leaving the needling machine and subsequent heat-setting, what is available is an endless felt belt, having a support 40 made up of a longitudinal yarn layer 41 and a transverse yarn layer 42, that can be used, for example, as a press felt in a paper machine.

Figure 5:
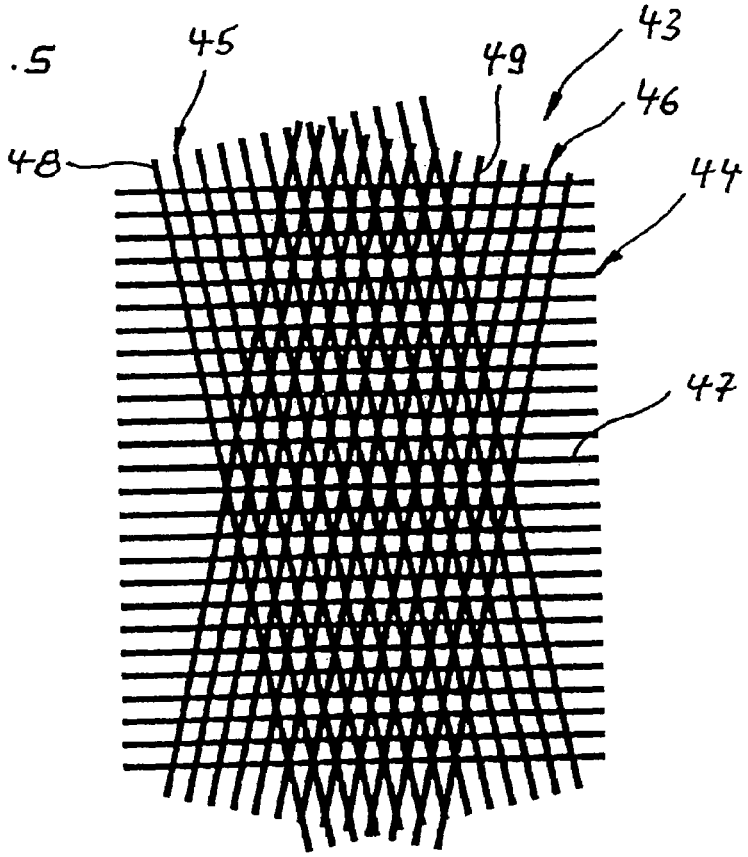
FIG. 5 is a top view of a modification of the support of the felt belt according to FIG. 4, without a fiber matrix.

FIG. 5 shows a variant support 43 having a longitudinal yarn layer 44 and two transverse yarn layers 45, 46. Longitudinal yarn layer 44 is made up of longitudinal yarns (labeled 47 by way of example) arranged parallel to one another at the same distance, whereas transverse yarn layers 45, 46 are each manufactured from transverse yarns arranged in parallel fashion and at a distance from one another. Only some of transverse yarns 48, 49 are depicted. Transverse yarn layer 45 is arranged on the upper side of longitudinal yarn layer 44, and transverse yarn layer 46 on the lower side. Transverse yarns 48 of transverse yarn layer 45 are set onto longitudinal yarns 47 obliquely at a specific positive angle to the perpendicular. Transverse yarns 49 of transverse yarn layer 46 are set onto longitudinal yarns 47 obliquely at an angle to the perpendicular that has the same absolute value but is negative.

Longitudinal yarn layer 44 was obtained by manufacturing a first support module in the manner described above. Transverse yarn layers 45, 46 were manufactured by the fact that corresponding support module segments were applied onto both sides of the first support module (or onto one side of the support module and thus abutting against one another), and were joined to one another. Manufacture is accomplished in the same fashion as for second support module 35 in the embodiment according to FIGS. 1 to 4. The oblique placement of transverse yarns 48, 49 was achieved by the fact that the support module segments were rectangularly dimensioned before having been placed obliquely onto the first support module.

Figure 6:
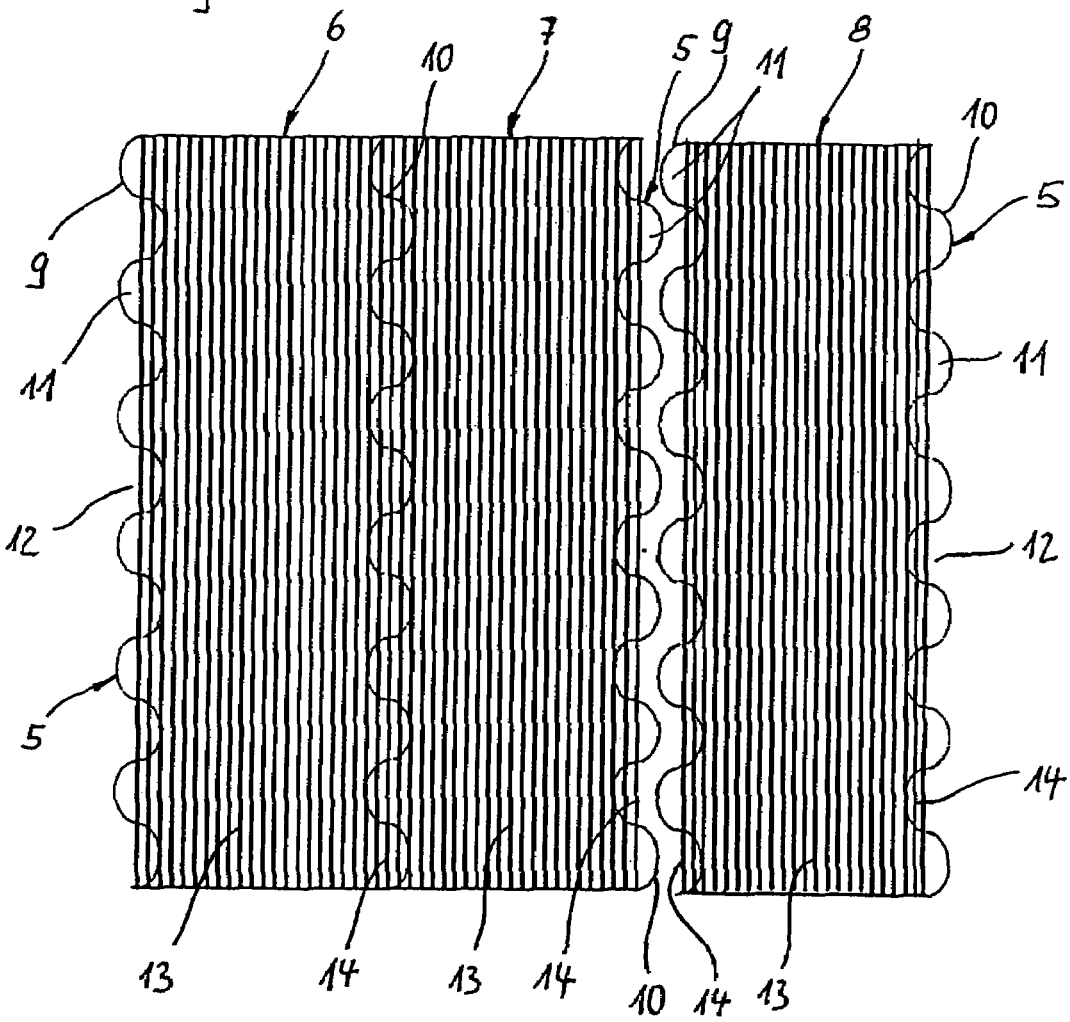
FIG. 6 is a top view, in an enlarged depiction, of a portion of the auxiliary support web for manufacturing the first support module.

FIG. 6 is a depiction analogous to FIG. 2, except that the manufacturing operation is different. Identical reference numbers are used for identical parts.

As in the case of the embodiment according to FIG. 2, three partial webs 6, 7, 8 of nonwoven fabric strip 5 are partly depicted. Partial webs 6, 7, 8 each have, on both longitudinal edges 9, 10, complementary undulating projections 11 made of nonwoven fabric, and indentations 12 complementary thereto. In the case of partial webs 6, 7, projections 11 and indentations 12 are already interengaging in the manner of a tooth set, whereas this is not yet the case for partial web 8 with respect to partial web 7.

On nonwoven fabric strip 5 and thus on partial webs 6, 7, 8, longitudinal yarns (labeled 13 by way of example) extend in the longitudinal direction parallel to and at equal distances from one another. They are welded in point fashion to nonwoven fabric strip 5 by the action of a laser beam moving transversely back and forth.

In contrast to the procedure in the case of the exemplifying embodiment according to FIG. 2, and as shown in particular by partial web 8, further longitudinal yarns (labeled 14 by way of example) are preferably applied together with longitudinal yarns 13 onto nonwoven fabric strip 5, and extend over projections 11 and indentations 12, specifically on both longitudinal edges 9, 10. These longitudinal yarns 14 are welded to projections 11 by the action of a laser beam, in the same manner as longitudinal yarns 13 are to nonwoven fabric strip 5. Longitudinal yarns 14 are at equal distances from one another and from longitudinal yarns 13, and extend parallel to the latter. Only two longitudinal yarns 14 are laid in each case over projections 11 and indentations 12, so that more than half the extension of projections 12 transversely to the extension of longitudinal yarns 13, 14 remains unoccupied.

The application of longitudinal yarns 13, 14 onto nonwoven fabric strip 5 can be accomplished in a corresponding apparatus even before nonwoven fabric strip 5, equipped with longitudinal yarns 13, 14, is wound onto supply spool 4. The possibility also exists, however, of applying longitudinal yarns 13, 14 only upon or after the unwinding of nonwoven fabric strip 5 from supply spool 4, and then placing partial webs 6, 7, 8 against one another in such a way that projections 11 interengage into indentations 12 in the manner of a tooth set. As is evident from the examples of partial webs 6, 7, longitudinal yarns 14 are supplemented by the complete interengagement of projections 11 and indentations 12 in such a way that the yarn density in this region is equal to the yarn density of longitudinal yarns 13 in the remaining region, and a uniform longitudinal yarn layer is thus created (the fact that partial webs 6, 7 already placed against one another are covered in the region of projections 11 and indentations 12 by only three longitudinal yarns 14, whereas a total of four longitudinal yarns 14 extend over projections 11 and indentations 12 of the two partial webs 7, 8 not yet placed against one another, is based simply on an illustrative inaccuracy). After interengagement, longitudinal yarns 14 on longitudinal edge 9 are joined to projections 11 on longitudinal edge 10 by the action of a laser beam. Conversely, longitudinal yarns 14 on longitudinal edge 10 are joined, likewise by laser action, to projections 11 of the abutting longitudinal edge 9.

The manner described above of joining longitudinal edges 9, 10 can also be correspondingly applied to the joining of support module segments 17, 18, 19 according to FIG. 3. Support module segments 17, 18, 19 are then equipped not only with transverse yarns 23, 24, 25, but additionally with transverse yarns 34 (applied simultaneously with transverse yarns 23, 24, 25) that extend over projections 32 and indentations 33. Only they are support module segments 17, 18, 19 placed successively against to one another, and joined to one another like partial webs 6, 7, 8 in the manner previously described.

We claim:

1. A method for manufacturing a felt belt having a support (40, 43), which latter is embedded in a fiber matrix and is made up of at least two yarn layers (41, 42, 44, 45) arranged one above another, of which at least one is embodied as a longitudinal yarn layer (41, 44) made up of longitudinal yarns (13, 14, 47) extending in parallel fashion, and at least one as a transverse yarn layer (42, 45, 46) made up of transverse yarns (23, 24, 25, 48, 49) extending in parallel fashion, transverse yarns (23, 24, 25, 48, 49) being present that are continuous over the entire width of the felt belt, characterized by at least the following steps:

a) for each longitudinal yarn layer (41, 44), a first support module (16) is manufactured as follows:

aa) a first auxiliary support web (5) is manufactured, at a width that is less than the width of the completed felt belt;

ab) the first auxiliary support web (5) is brought together with yarns (13, 14) which have the property of absorbing laser energy and of being able to be brought by means of laser energy at least superficially and at least partially to melting temperature;

ac) the yarns (13, 14) are joined to the first auxiliary support web (5) by the action of a laser beam;

ad) before, during, or after application of the yarns (13, 14), the first auxiliary support web (5) is wound in helical fashion to a width that, if applicable after trimming of the side edges, corresponds to the width necessary for manufacture of the completed felt belt;

b) for each transverse yarn layer (42, 45, 46), a second support module (35) that completely covers the first one is manufactured as follows:

ba) firstly, individual support module segments (17, 18, 19) are manufactured, having an extension in one direction that corresponds to the width necessary for manufacture of the completed felt belt;

bb) the support module segments (17, 18, 19) are each made up of a combination of a second auxiliary support web (20, 21, 22) and yarns (23, 24, 25, 48, 49), attached thereon, that have the property of absorbing laser energy and of being able to be brought by means of laser energy at least superficially and at least partially to melting temperature;

bc) the join between the second auxiliary support web (20, 21, 22) and the yarns (23, 24, 25, 48, 49) has been produced by the action of a laser beam on the yarns (23, 24, 25, 48, 49);

bd) for manufacture of a support belt, the support module segments (17, 18, 19) are placed onto and against one another onto the first support module (16), one behind another in the latter's longitudinal direction, so that a second support module (35) is created having yarns (23, 24, 25, 48, 49) that extend transversely to the yarns (13, 14) of the first support module (16);

c) for manufacture of the felt belt, at least one nonwoven fabric layer (38, 39) is needle-felted onto at least one side of the support modules (16, 35), forming the fiber matrix.

2. The method according to claim 1, wherein yarns (13, 14, 23, 24, 25, 47, 48, 49) are used which contain an additive that makes the yarns (13, 14, 23, 24, 25, 47, 48, 49) absorptive for the laser beam.

3. The method according to claim 1, wherein a nonwoven fabric and/or a network and/or a film is used for the auxiliary support webs (5, 20, 21, 22).

4. The method according to claim 1, wherein the nonwoven fabrics are manufactured with a weight per unit area from 20 to 150 g/m$^2$, preferably from 30 to 60 g/m$^2$.

5. The method according to claim 1, wherein the yarns (13, 14,23, 24, 25, 47, 48, 49) are arranged parallel to the parallel side edges of the auxiliary support webs (5, 20, 21, 22).

6. The method according to claim 1, wherein the first auxiliary support web (5) is manufactured at a width from 0.2 to 1.5 m.

7. The method according to claim 1, wherein the second auxiliary support web (20, 21, 22) is manufactured with an extension, transversely to the yarns, from 0.5 to 6 m.

8. The method according to claim 1, wherein the first auxiliary support web (5) and/or the support module segments (17, 18, 19) are joined to one another at their mutually abutting edges (9, 10, 26 to 31).

9. The method according to claim 8, wherein the edges are caused to overlap and are joined to one another in the overlap region.

10. The method according to claim 9, wherein the edges are stitched and/or welded and/or adhesively bonded to one another.

11. The method according to claim 8, wherein the edges (9, 10, 26 to 31) are butted against one another.

12. The method according to claim 11, wherein the edges (9, 10, 26 to 31) are equipped with successive, complementary projections (11, 32) and indentations (12, 33); and the edges (9, 10, 26 to 31) are placed against one another so that they interengage with their projections (11, 32) and indentations (12, 33); and projections (11, 32) of the abutting edges (9, 10, 26 to 31) are joined to one another.

13. The method according to claim 12, wherein at least one yarn (14, 34) is laid over the projections (11, 32) after interengagement of the projections (11, 32) and indentations (12, 33), and attached to them.

14. The method according to claim 12, wherein before interengagement of the projections (11, 32) and indentations (12, 33), at least one yarn is laid over the projections (11, 32) and indentations (12, 33) and attached to the projections (11, 32) on at least one edge (9, 10, 26 to 31); and after interengagement of the projections (11, 32) and indentations (12, 33), the at least one yarn (14, 34) is also attached to the projections (11, 32) of the butt-adjoining edge (9, 10, 26 to 31).

15. The method according to claim 14, wherein at least one yarn (14, 34) is attached to the projections (11, 32) of the two edges (9, 10, 26 to 31) of the auxiliary support webs (5, 20, 21, 22).

16. The method according to claim 12, wherein the yarns (14, 34) extending over the edges (9, 10, 26 to 31) correspond to the other yarns (13, 23, 24, 25,47, 48, 49).

17. The method according to claim 12, wherein the yarns (14, 34) are applied onto the projections in a quantity and at a distance such that after interengagement, the yarn density in the region of the edges (9, 10, 26 to 31) does not differ from the yarn density elsewhere.

18. A felt belt, in particular a paper machine felt, having a support (40, 43), which latter is embedded in a fiber matrix and is made up of at least two yarn layers (41, 42, 44, 45, 46) arranged one above another, of which at least one is embodied as a longitudinal yarn layer (41, 44) made up of longitudinal yarns (13, 14, 47) extending in parallel fashion, and at least one as a transverse yarn layer (42, 45, 46) made up of transverse yarns (23, 24, 25, 48, 49) extending in parallel fashion, transverse yarns (23, 24, 25, 48, 49) being present that are continuous and uninterrupted over the width of the felt belt, and the yarns (13, 14, 23, 24, 25, 47, 48, 49) having the property of absorbing laser energy and of being capable of being brought by means of laser energy at least partially to melting temperature, wherein the longitudinal yarns (13, 14, 47) extend at an angle to the longitudinal direction of the felt belt.

19. The felt belt according to claim 18, wherein the longitudinal and transverse yarns are merely laid onto one another.

20. The felt belt according to claim 18, wherein the yarns (13, 14, 23, 24, 25, 47, 48, 49) contain an additive that makes them absorptive for laser energy.

21. The felt belt according to claim 18, wherein the yarns (13, 14, 23, 24, 25, 47, 48, 49) of at least one yarn layer (41, 42, 44, 45, 46) are embodied as monofilaments.

22. The felt belt according to claim 18, wherein the yarns of at least one yarn layer are embodied as multifilaments made up of individual filaments.

23. The felt belt according to claim 18, wherein the yarns of at least one yarn layer are embodied as monofilament twisted yarns made up of at least two monofilaments.

24. The felt belt according to claim 20, wherein a maximum of half the yarns are equipped with the additive.

25. The felt belt according to claim 18, wherein different yarns are used alternately.

26. The felt belt according to claim 25, wherein alternately yarns made of polyamide 6 and 6.10, or alternately yarns made of polyamide 6 and 6.12, or alternately yarns made of polyamide 6.6 and polyester, are present.

27. The felt belt according to claim 25, wherein alternately monofilaments and twisted yarns, alternately twisted yarns and multifilaments, or alternately monofilaments and multifilaments, are provided.

28. The felt belt according to claim 18, wherein the support is made up of at least two longitudinal yarn layers and at least one transverse yarn layer.

29. The felt belt according to claim 18, wherein the support (43) is made up of at least one longitudinal yarn layer (44) and at least two transverse yarn layers (45, 46).

30. The felt belt according to claim 18, wherein the support is made up of at least two longitudinal yarn layers and two transverse yarn layers.

31. The felt belt according to claim 18, wherein a longitudinal yarn layer (44) and transverse yarn layer (45, 46) alternate.

32. The felt belt according to claim 18, wherein the transverse yarns (23, 24, 25, 48, 49) extend at an angle from 75° to 125° to the longitudinal direction of the felt belt.

33. The felt belt according to claim 32, wherein the transverse yarns (23, 24, 25, 48, 49) extend at an angle to the longitudinal direction of the felt belt that is greater or less than 90°.

34. The felt belt according to claim 18, wherein the support (43) comprises at least two transverse yarn layers (45, 46), and the transverse yarns (48) of the one transverse yarn layer (45) and the transverse yarns (49) of the other transverse yarn layer (46) intersect.

35. The felt belt according to claim 34, wherein the transverse yarns (48) of the one transverse yarn layer (45) differ from the perpendicular to the longitudinal direction of the felt belt by the same angle as the transverse yarns (49) of the other transverse yarn layer (46).

36. The felt belt according to claim 18, wherein the longitudinal yarns (13, 14,47) and/or the transverse yarns (23, 24, 25, 48, 49) are at equal distances from one another.

37. The felt belt according to claim 36, wherein the distance of the longitudinal yarns (13, 14, 47) and the distance of the transverse yarns (23, 24, 25, 48, 49) is the same.

* * * * *

UNITED STATES PATENT AND TRADEMARK OFFICE

CERTIFICATE OF CORRECTION

PATENT NO. : 7,722,743 B2
APPLICATION NO. : 11/723520
DATED : March 16, 2010
INVENTOR(S) : Walter Best, Christian Molls and Dieter Telgmann It is certified that error appears in the above-identified patent and that said Letters Patent is hereby corrected as shown below:

On the Title page in the listing of Foreign Application Priority Data Item [30], please replace priority number "20 2006 004 524 U" with "20 2006 004 624 U" as shown on the declaration filed with the application.

Signed and Sealed this

Twenty-eighth Day of September, 2010

David J. Kappos

David J. Kappos
*Director of the United States Patent and Trademark Office*